US006872427B2

(12) United States Patent
Van Steenkiste et al.

(10) Patent No.: US 6,872,427 B2
(45) Date of Patent: Mar. 29, 2005

(54) METHOD FOR PRODUCING ELECTRICAL CONTACTS USING SELECTIVE MELTING AND A LOW PRESSURE KINETIC SPRAY PROCESS

(75) Inventors: Thomas Hubert Van Steenkiste, Ray, MI (US); Daniel William Gorkiewicz, Washington, MI (US); George Albert Drew, Warren, OH (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/361,207

(22) Filed: Feb. 7, 2003

(65) Prior Publication Data

US 2004/0157000 A1 Aug. 12, 2004

(51) Int. Cl.[7] ..... B05D 1/02

(52) U.S. Cl. ..... 427/455; 427/191; 427/422; 427/427; 427/424

(58) Field of Search ..... 427/455, 422, 427/427, 424, 191

(56) References Cited

U.S. PATENT DOCUMENTS

| | | | |
|---|---|---|---|
| 2,861,900 | A | 11/1958 | Smith et al. |
| 3,100,724 | A | 8/1963 | Rocheville |
| 3,876,456 | A | 4/1975 | Ford et al. |
| 3,993,411 | A | 11/1976 | Babcock et al. |
| 3,996,398 | A | 12/1976 | Manfredi |
| 4,263,335 | A | 4/1981 | Wagner et al. |
| 4,416,421 | A | 11/1983 | Browning et al. |
| 4,606,495 | A | 8/1986 | Stewart, Jr. et al. |
| 4,891,275 | A | 1/1990 | Knoll |
| 4,939,022 | A | 7/1990 | Palanisamy |

(Continued)

FOREIGN PATENT DOCUMENTS

| | | | |
|---|---|---|---|
| DE | 42 36 911 | | 12/1993 |
| DE | 199 59 515 | | 6/2001 |
| DE | 100 37 212 | | 1/2002 |
| DE | 101 26 100 | | 12/2002 |
| EP | 1 160 348 | | 12/2001 |
| EP | 1245854 | A2 | 2/2002 |
| JP | 55031161 | | 3/1980 |
| JP | 61249541 | | 11/1986 |
| JP | 04180770 | | 6/1992 |
| JP | 04243524 | | 8/1992 |
| WO | 98/22639 | * | 5/1998 |
| WO | 02/052064 | | 1/2002 |
| WO | 03009934 | | 2/2003 |

OTHER PUBLICATIONS

US Provisional 60/382,950.*

"An Exploration of the Cold–Dynamic Spray Method", McCune et al.; Proc. Nat. Thermal Spray Conf. ASM Sep. 1995.

(Continued)

*Primary Examiner*—Katherine Bareford
(74) *Attorney, Agent, or Firm*—Scott A. McBain

(57) ABSTRACT

A new kinetic spray process is disclosed that enables the coating to withstand severe bending and stress without delamination. The method includes use of a low pressure kinetic spray supersonic nozzle having a throat located between a converging region and a diverging region. A main gas temperature is raised to from 1000 to 1300 degrees Fahrenheit and the coating particles are directly injected into the diverging region of the nozzle at a point after the throat. The particles are entrained in the flow of the gas and accelerated to a velocity sufficient to result in partial melting of the particles upon impact on a substrate positioned opposite the nozzle and adherence of the particles to the substrate. The coating also has a desirable shinny surface. The method finds special application in coating substrates for use in formation of electrical connections.

20 Claims, 11 Drawing Sheets

U.S. PATENT DOCUMENTS 5,187,021 A 2/1993 Vydra et al.
5,217,746 A 6/1993 Lenling et al.
5,271,965 A 12/1993 Browning
5,302,414 A * 4/1994 Alkhimov et al. ..... 427/192
5,308,463 A 5/1994 Hoffmann et al.
5,328,751 A 7/1994 Komorita et al.
5,340,015 A 8/1994 Hira et al.
5,362,523 A 11/1994 Gorynin et al.
5,395,679 A 3/1995 Myers et al.
5,424,101 A 6/1995 Atkins et al.
5,464,146 A 11/1995 Zalvzec et al.
5,465,627 A 11/1995 Garshelis
5,476,725 A 12/1995 Papich et al.
5,493,921 A 2/1996 Alasafi
5,520,059 A 5/1996 Garshelis
5,525,570 A 6/1996 Chakraborty et al.
5,527,627 A 6/1996 Lautzenhiser et al.
5,585,574 A 12/1996 Sugihara et al.
5,593,740 A 1/1997 Strumban et al.
5,648,123 A 7/1997 Kuhn et al.
5,683,615 A 11/1997 Munoz
5,706,572 A 1/1998 Garshelis
5,708,216 A 1/1998 Garshelis
5,725,023 A 3/1998 Padula
5,795,626 A 8/1998 Grabel et al.
5,854,966 A 12/1998 Kampe et al.
5,887,335 A 3/1999 Garshells
5,889,215 A 3/1999 Kilmartin et al.
5,894,054 A 4/1999 Paruchuri et al.
5,907,105 A 5/1999 Pinkerton
5,907,761 A 5/1999 Tohma et al.
5,952,056 A 9/1999 Jordan et al.
5,965,193 A 10/1999 Ning et al.
5,989,310 A 11/1999 Chu et al.
5,993,565 A 11/1999 Pinkerton
6,033,622 A 3/2000 Maruyama
6,047,605 A 4/2000 Garshelis
6,051,045 A 4/2000 Narula et al.
6,051,277 A 4/2000 Claussen et al.
6,074,737 A 6/2000 Jordan et al.
6,098,741 A 8/2000 Gluf
6,119,667 A 9/2000 Boyer et al.
6,129,948 A 10/2000 Plummer et al.
6,139,913 A * 10/2000 Van Steenkiste et al. ... 427/191
6,145,387 A 11/2000 Garshelis
6,149,736 A 11/2000 Sugihara
6,159,430 A 12/2000 Foster
6,189,663 B1 2/2001 Smith et al.
6,260,423 B1 7/2001 Garshelis
6,261,703 B1 7/2001 Sasaki et al.
6,283,386 B1 9/2001 Van Steenkiste et al.
6,283,859 B1 9/2001 Carlson et al.
6,289,748 B1 9/2001 Lin et al.
6,338,827 B1 1/2002 Nelson et al.
6,344,237 B1 2/2002 Kilmer et al.
6,374,664 B1 4/2002 Bauer
6,402,050 B1 6/2002 Kashirin et al.
6,422,360 B1 7/2002 Oliver et al.
6,424,896 B1 7/2002 Lin
6,442,039 B1 8/2002 Schreiber
6,446,857 B1 9/2002 Kent et al.
6,465,039 B1 10/2002 Pinkerton et al.
6,485,852 B1 11/2002 Miller et al.
6,488,115 B1 12/2002 Ozsoylu
6,490,934 B2 12/2002 Garshelis
6,511,135 B2 1/2003 Ballinger et al.
6,537,507 B2 3/2003 Nelson et al.
6,551,734 B1 4/2003 Simpkins et al.
6,553,847 B2 4/2003 Garshelis
6,615,488 B2 9/2003 Anders
6,623,704 B1 9/2003 Roth
6,623,796 B1 9/2003 Van Steenkiste
6,624,113 B2 9/2003 LaBarge et al.
2002/0071906 A1 * 6/2002 Rusch ..... 427/180
2002/0073982 A1 6/2002 Shaikh et al.
2002/0102360 A1 8/2002 Subramanian et al.
2002/0110682 A1 * 8/2002 Brogan ..... 428/325
2002/0112549 A1 8/2002 Cheshmehdoost et al.
2002/0182311 A1 * 12/2002 Leonardi et al. ..... 427/128
2003/0039856 A1 2/2003 Gillispie et al.
2003/0190414 A1 * 10/2003 Van Steenkiste ..... 427/201
2003/0219542 A1 * 11/2003 Ewasyshyn et al. ..... 427/421

OTHER PUBLICATIONS

I.J. Garshelis, et al; *A Magnetoelastic Torque Transducer Utilizing a Ring Divided into Two Oppositely Polarized Circumferential Regions*; MMM 1995; Paper No. BB–08.

I.J. Garshelis, et al; *Development of a Non–Contact Torque Transducer for Electric Power Steering Systems*; SAE Paper No. 920707; 1992; pp. 173–182.

Boley, et al; *The Effects of Heat Treatment on the Magnetic Behavior of Ring—Type Magnetoelastic Torque Sensors*; Proceedings of Sicon '01; Nov. 2001.

J.E. Snyder, et al; *Low Coercivity Magnetostrictive Material with Giant Piezomagnetic d33*, Abstract Submitted for the MAR99 Meeting of the American Physical Society.

Pavel Ripka, et al; *Pulse Excitation of Micro–Fluxgate Sensors*, IEEE Transactions on Magnetics, vol. 37, No. 4, Jul. 2001, pp. 1998–2000.

Trifon M. Liakopoulos, et al; *Ultrahigh Resolution DC Magnetic Field Measurements Using Microfabricated Fluxgate Sensor Chips*, University of Cincinnati, Ohio, Center for Microelectronic Sensors and MEMS, Dept. of ECECS pp. 630–631.

Derac Son, *A New Type of Fluxgate Magnetometer Using Apparent Coercive Field Strength Measurement*, IEEE Transactions on Magnetics, vol. 25, No. 5, Sep. 1989, pp. 3420–3422.

O. Dezauri, et al; *Printed Circuit Board Integrated Fluxgate Sensor*, Elsevier Science S.A. (2000) Sensors and Actuators, pp. 200–203.

How, et al; *Generation of High–Order Harmonics in Insulator Magnetic Fluxgate Sensor Cores*, IEEE Transactions on Magnetics, vol. 37, No. 4, Jul. 2001, pp. 2448–2450.

Moreland, *Fluxgate Magnetometer*, Carl W. Moreland, 199–2000, pp. 1–9.

Ripka, et al; *Symmetrical Core Improves Micro–Fluxgate Sensors*, Sensors and Acutuators, Version I, Aug. 25, 2000, pp. 1–9.

Hoton How, et al; *Development of High–Sensitivity Fluxgate Magnetometer Using Single–Crystal Yttrium Iron Garnet Thick Film as the Core Material, ElectroMagnetic Applications, Inc.*

Ripka, et al; *Microfluxgate Sensor with Closed Core*, submitted for Sensors and Actuators, Version 1, Jun. 17, 2000.

Henriksen, et al; *Digital Detection and Feedback Fluxgate Magnetometer*, Meas. Sci. Technol. 7 (1996) pp. 897–903.

Cetek 930580 Compass Sensor, *Specifications*, Jun. 1997.

Geyger, *Basic Principles Characteristics and Applications*, Magnetic Amplifier Circuits, 1954, pp. 219–232.

Van Steenkiste, et al; *Kinetic Spray Coatings*; in Surface & Coatings Technology III; 1999; pp. 62–71.

Liu, et al; *Recent Development in the Fabrication of Metal Matrix–Particulate Composites Using Powder Metallurgy Techniques*; in Journal of Material Science 29; 1994; pp. 1999–2007; National University of Singapore, Japan.
Papyrin; *The Cold Gas–Dynamic Spraying Method a New Method for Coatings Deposition Promises a New Generation of Technologies*; Novosibirsk, Russia (no date).
McCune, al; Characterization of Copper and Steel Coatings Made by the Cold Gas–Dynamic Spray Method; National Thermal Spray Conference (no date).
Alkhimov, et al; *A Method of "Cold" Gas–Dynamic Deposition; Sov. Phys. Kokl. 36*(Dec. 12, 1990; pp. 1047–1049.
Dykuizen, et al.; *Impact of High Velocity Cold Spray Particles*; in Journal of Thermal Spray Technology 8(4); 1999; pp. 559–564.
Swartz, et al; *Thermal Resistance At Interfaces; Appl. Phys. Lett., vol. 51, No. 26*, Dec. 28, 1987; pp. 2201–2202.
Davis, et al; *Thermal Conductivity of Metal–Matrix Composlites; J.Appl. Phys. 77* (*10*), May 15, 1995; pp. 4494–4960.
Stoner et al; *Measurements of the Kapitza Conductance between Diamond and Several Metals*; Physical Review Letters, vol. 68, No. 10; Mar. 9, 1992; pp. 1563–1566.
Stoner et al; *Kapitza conductance and heat flow between solids at temperatures from 50 to 300K*; Physical Review B, vol. 48, No. 22, Dec. 1, 1993–II; pp. 16374;16387.
Johnson et al; *Diamond/Al metal matrix composites formed by the pressureless metal infiltration process*; J. Mater, Res., vol. 8, No. 5, May 1993; pp. 11691173.
Rajan et al; *Reinforcement coatings and interfaces in Aluminium Metal Matrix Composites*; pp. 3491–3503 1998.
*LEC Manufacturing and Engineering Capabilities*; Lanxide Electronic Components, Inc.
Dykhuizen et al; *Gas Dynamic Principles of Cold Spray*; Journal of Thermal Spray Technology; 06–98; pp. 205–212.
McCune et al; *An Exploration of the Cold Gas–Dynamic Spray Method For Several Materials Systems.*
Ibrahim et al; *Particulate Reinforced Metal Matrix Composites—A Review; Journal of Matrials Science 26*; pp. 1137–1156.

* cited by examiner

METHOD FOR PRODUCING ELECTRICAL CONTACTS USING SELECTIVE MELTING AND A LOW PRESSURE KINETIC SPRAY PROCESS

TECHNICAL FIELD

The present invention is directed toward a method for producing an electrical contact using a kinetic spray process, and more particularly, toward a method that includes selective melting of kinetically sprayed particles.

INCORPORATION BY REFERENCE

The present invention comprises an improvement to the kinetic spray process as generally described in U.S. Pat. Nos. 6,139,913, 6,283,386 and the articles by Van Steenkiste, et al. entitled "Kinetic Spray Coatings" published in Surface and Coatings Technology Volume III, Pages 62–72, Jan. 10, 1999, and "Aluminum coatings via kinetic spray with relatively large powder particles", published in Surface and Coatings Technology 154, pp. 237–252, 2002, all of which are herein incorporated by reference.

BACKGROUND OF THE INVENTION

A new technique for producing coatings on a wide variety of substrate surfaces by kinetic spray, or cold gas dynamic spray, was recently reported in two articles by T. H. Van Steenkiste et al. The first was entitled "Kinetic Spray Coatings," published in Surface and Coatings Technology, vol. 111, pages 62–71, Jan. 10, 1999 and the second was entitled "Aluminum coatings via kinetic spray with relatively large powder particles", published in Surface and Coatings Technology 154, pp. 237–252, 2002. The articles discuss producing continuous layer coatings having high adhesion, low oxide content and low thermal stress. The articles describe coatings being produced by entraining metal powders in an accelerated gas stream, through a converging-diverging de Laval type nozzle and projecting them against a target substrate. The particles are accelerated in the high velocity gas stream by the drag effect. The gas used can be any of a variety of gases including air or helium. It was found that the particles that formed the coating did not melt or thermally soften prior to impingement onto the substrate. It is theorized that the particles adhere to the substrate when their kinetic energy is converted to a sufficient level of thermal and mechanical deformation. Thus, it is believed that the particle velocity must exceed a critical velocity high enough to exceed the yield stress of the particle to permit it to adhere when it strikes the substrate. It was found that the deposition efficiency of a given particle mixture was increased as the inlet air temperature was increased. Increasing the inlet air temperature decreases its density and thus increases its velocity. The velocity varies approximately as the square root of the inlet air temperature. The actual mechanism of bonding of the particles to the substrate surface is not fully known at this time. The critical velocity is dependent on the material of the particle. Once an initial layer of particles has been formed on a substrate subsequent particles bind not only to the voids between previous particles bound to the substrate but also engage in particle to particle bonds. The bonding process is not due to melting of the particles in the particles because the temperature of the particles is always below their melting temperature.

One aspect of the technique is that the particles are entrained in the converging side of the nozzle, pass through a narrow throat and then are expelled from the diverging section of the nozzle onto a substrate. One difficulty that can arise is that with certain particles sizes the throat can rapidly become plugged. In a recent related United States application, filed Apr. 5, 2002 and assigned Ser. No. 10/117,385 this was addressed through a modification of the kinetic spray technique that involves injection of the particles into the diverging region of the nozzle and then entraining them in the accelerated gas stream. The technique removes clogging of the nozzle throat as a limitation and reduces the wear on the nozzle.

Using the basic technique attempts were made to coat electrical contact substrates with tin particles. The particles adhered to and coated the electrically conductive substrates. During impact fracturing occurs in the particles as they plastically deform and adhere to a substrate and other particles. It was found, however, upon subsequent bending of the coated substrates to form them into the required terminal shape the particles broke internally along these fracture lines and left a fragment of the original tin particle at the break on the substrate. These broken particles negatively affect the substrate surface. The present invention is directed to a method of overcoming the particle fracturing behaviour and to design a coating that could withstand severe bending without damage.

SUMMARY OF THE INVENTION

In one embodiment the present invention is a method of kinetic spray coating a substrate comprising the steps of: providing particles of a tin to be sprayed; providing a supersonic nozzle having a throat located between a converging region and a diverging region; directing a flow of a gas through the nozzle, the gas having a temperature of from 1000 to 1300 degrees Fahrenheit; and injecting the particles directly into the diverging region of the nozzle at a point after the throat, entraining the particles in the flow of the gas and accelerating the particles to a velocity sufficient to result in partial melting of the particles upon impact on a substrate positioned opposite the nozzle and adherence of the particles to the substrate.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
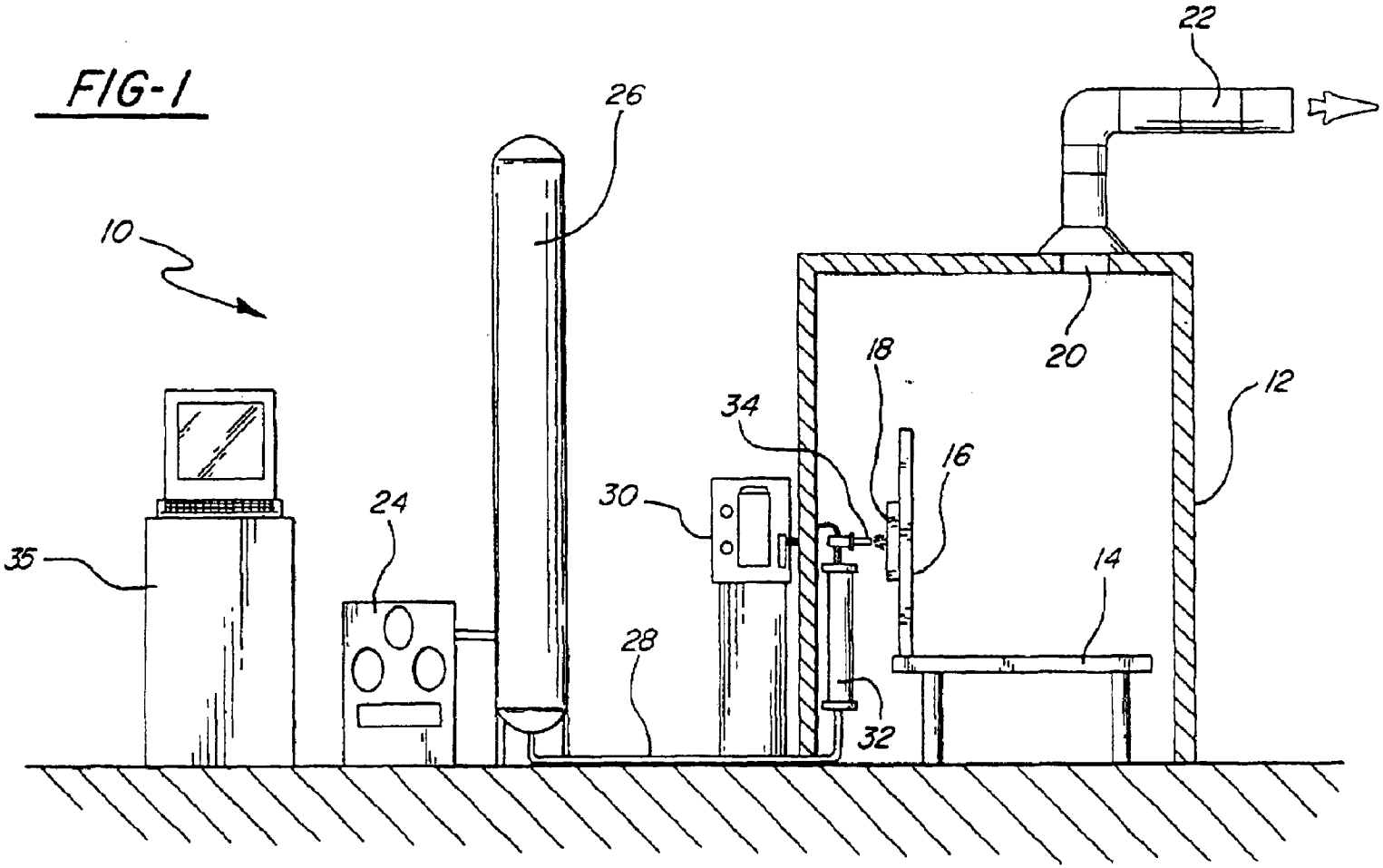
FIG. 1 is a generally schematic layout illustrating a kinetic spray system for performing the method of the present invention.

Referring first to FIG. 1, a kinetic spray system according to the present invention is generally shown at 10. System 10 includes an enclosure 12 in which a support table 14 or other support means is located. A mounting panel 16 fixed to the table 14 supports a work holder 18 capable of movement in three dimensions and able to support a suitable workpiece formed of a substrate material to be coated. The work holder 18 is preferably designed to feed a substrate material past a nozzle 34 at traverse speeds of from 20 to 400 feet/minute, more preferably at speeds of from 30 to 50 feet/minute. The enclosure 12 includes surrounding walls having at least one air inlet, not shown, and an air outlet 20 connected by a suitable exhaust conduit 22 to a dust collector, not shown. During coating operations, the dust collector continually draws air from the enclosure 12 and collects any dust or particles contained in the exhaust air for subsequent disposal.

The spray system 10 further includes an air compressor 24 capable of supplying air pressure up to 3.4 MPa (500 psi) to a high pressure air ballast tank 26. The air ballast tank 26 is connected through a line 28 to both a low pressure powder feeder 30 and a separate air heater 32. The air heater 32 supplies high pressure heated air, the main gas described below, to a kinetic spray nozzle 34. The pressure of the main gas generally is set at from 150 to 500 psi, more preferably from 300 to 400 psi. The low pressure powder feeder 30 mixes particles of a spray powder and supplies the mixture of particles to the nozzle 34. Preferably the particles are fed at a rate of from 20 to 80 grams per minute to the nozzle 34. A computer control 35 operates to control both the pressure of air supplied to the air heater 32 and the temperature of the heated main gas exiting the air heater 32.

Figure 2:
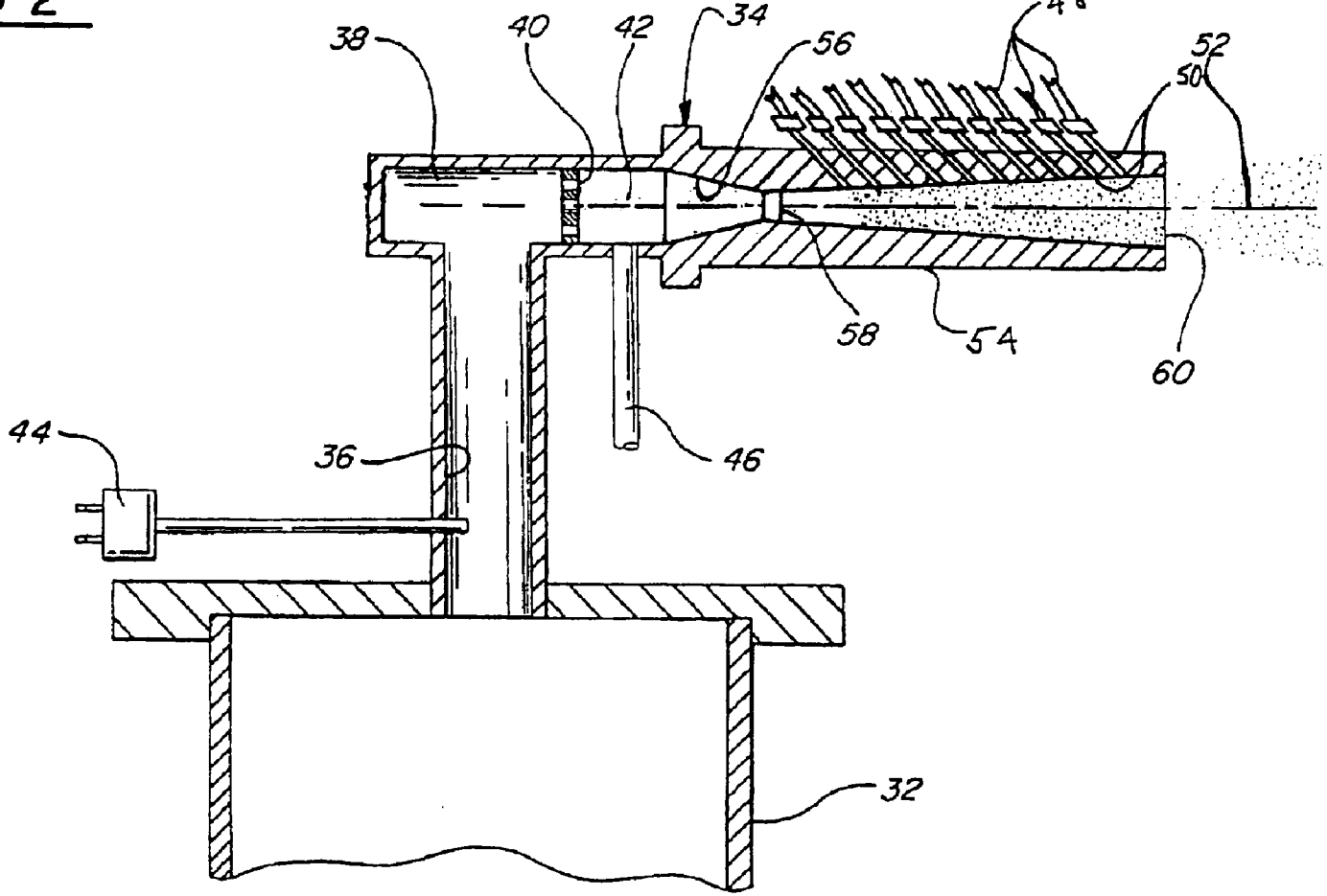
FIG. 2 is an enlarged cross-sectional view of a kinetic spray nozzle used in the system.

FIG. 2 is a cross-sectional view of the nozzle 34 and its connections to the air heater 32 and the powder feeder 30. A main air passage 36 connects the air heater 32 to the nozzle 34. Passage 36 connects with a premix chamber 38 that directs air through a flow straightener 40 and into a chamber 42. Temperature and pressure of the air or other heated main gas are monitored by a gas inlet temperature thermocouple 44 in the passage 36 and a pressure sensor 46 connected to the chamber 42. The main gas has a temperature that is always insufficient to cause melting within the nozzle 34 of any particles being sprayed. The main gas temperature can be well above the melt temperature of the particles. Main gas temperatures that are 5 to 7 fold above the melt temperature of the particles have been used in the present system 10. As discussed below, for the present invention it is preferred that the main gas temperature range from 1000 to 1300° F., and more preferably from 1100 to 1300° F. What is necessary is that the temperature and exposure time to the main gas be selected such that the particles do not melt in the nozzle 34. The temperature of the gas rapidly falls as it travels through the nozzle 34. In fact, the temperature of the gas measured as it exits the nozzle 34 is often at or below room temperature even when its initial temperature is above 1000° F.

Chamber 42 is in communication with a de Laval type supersonic nozzle 54. The nozzle 54 has a central axis 52 and an entrance cone 56 that decreases in diameter to a throat 58. The entrance cone 56 forms a converging region of the nozzle 54. Downstream of the throat 58 is an exit end 60 and a diverging region is defined between the throat 58 and the exit end 60. The largest diameter of the entrance cone 56 may range from 10 to 6 millimeters, with 7.5 millimeters being preferred. The entrance cone 56 narrows to the throat 58. The throat 58 may have a diameter of from 3.5 to 1.5 millimeters, with from 3 to 2 millimeters being preferred. The diverging region of the nozzle 54 from downstream of the throat 58 to the exit end 60 may have a variety of shapes, but in a preferred embodiment it has a rectangular cross-sectional shape. At the exit end 60 the nozzle 54 preferably has a rectangular shape with a long dimension of from 8 to 14 millimeters by a short dimension of from 2 to 6 millimeters.

The de Laval nozzle 54 is modified from previous systems in the diverging region. In the present invention a mixture of unheated low pressure air and coating powder is fed from the powder feeder 30 through one of a plurality of supplemental inlet lines 48 each of which is connected to a powder injector tube 50 comprising a tube having a predetermined inner diameter. For simplicity the actual connections between the powder feeder 30 and the inlet lines 48 are not shown. The injector tubes 50 supply the particles to the nozzle 54 in the diverging region downstream from the throat 58, which is a region of reduced pressure. The length of the nozzle 54 from the throat 58 to the exit end can vary widely and typically ranges from 100 to 400 millimeters.

As would be understood by one of ordinary skill in the art the number of injector tubes 50, the angle of their entry relative to the central axis 52 and their position downstream from the throat 58 can vary depending on any of a number of parameters. In FIG. 2 ten injector tubes 50 are show, but the number can be as low as one and as high as the available room of the diverging region. The angle relative to the central axis 52 can be any that ensures that the particles are directed toward the exit end 60, basically from 1 to about 90 degrees. It has been found that an angle of 45 degrees relative to central axis 52 works well. An inner diameter of the injector tube 50 can vary between 0.4 to 3.0 millimeters. The use of multiple injector tubes 50 permits one to easily modify the system 10. One can rapidly change particles by turning off a first powder feeder 30 connected to a first injector tube 50 and the turning on a second powder feeder 30 connected to a second injector tube 50. Such a rapid change over is not easily accomplished with prior systems. For simplicity only one powder feeder 30 is shown in FIG. 1, however, as would be understood by one of ordinary skill in the art, the system 10 could include a plurality of powder feeders 30.

Using a nozzle 54 having a length of 300 millimeters from throat 58 to exit end 60, a throat of 2.8 millimeters, an exit end 60 with a rectangular opening of 5 by 12.5 millimeters, main gas pressure of 300 psi, main gas temperature of 700°

F., and an injector tube 50 angle of 45 degrees, the pressure drops quickly as one goes downstream from the throat 58. The measured pressures were: 14 psi at 1 inch after the throat 58; 10 psi at 2 inches from the throat 58; 20 psi at 3 inches from the throat 58; 22 psi at 4 inches from the throat 58; 22 psi at 5 inches from the throat 58 and below atmospheric pressure beyond 6 inches from the throat 58. For the present invention it is preferred that the injector tube 50 be located a distance of from 0.5 to 5 inches from the throat, more preferably from 0.5 to 2 inches, and most preferably from 0.5 to 1 inches. These results show that one can use much lower pressures to inject the powder when the injection takes place after the throat 58. The low pressure powder feeder 30 of the present invention has a cost that is approximately ten-fold lower than the high pressure powder feeders that have been used in past systems. Generally, the low pressure powder feeder 30 is used at a pressure of 100 psi or less, most preferably from 5 to 60 psi. All that is required is that it exceed the main gas pressure at the point of injection.

The nozzle 54 preferably produces an exit velocity of the entrained particles of from 300 meters per second to 800 meters per second. The entrained particles gain kinetic and thermal energy during their flow through this nozzle 54. It will be recognized by those of skill in the art that the temperature of the particles in the gas stream will vary depending on the particle size and the main gas temperature. The main gas temperature is defined as the temperature of heated high-pressure gas at the inlet to the nozzle 54. The importance of the main gas temperature is discussed more fully below.

It is preferred that the exit end 60 of the nozzle 54 have a standoff distance of from 10 to 40 millimeters, more preferably from 15 to 30 millimeters, and most preferably from 15 to 20 millimeters from the surface of the substrate. Upon striking a substrate opposite the nozzle 54 the particles flatten into a nub-like structure with an aspect ratio of generally about 5 to 1. When the substrate is a metal and the particles are a metal the particles striking the substrate surface fracture the oxidation on the surface layer and subsequently form a direct metal-to-metal bond between the metal particle and the metal substrate. Upon impact the kinetic sprayed particles transfer substantially all of their kinetic and thermal energy to the substrate surface and stick if their yield stress has been exceeded. As discussed above, for a given particle to adhere to a substrate it is necessary that it reach or exceed its critical velocity which is defined as the velocity where at it will adhere to a substrate when it strikes the substrate after exiting the nozzle 54. This critical velocity is dependent on the material composition of the particle. In general, harder materials must achieve a higher critical velocity before they adhere to a given substrate. It is not known at this time exactly what is the nature of the particle to substrate bond; however, it is believed that a portion of the bond is due to the particles plastically deforming upon striking the substrate. Preferably the particles have an average nominal diameter of from 60 to 90 microns.

EXPERIMENTAL DATA

It was initially believed that the present system could be used to coat brass substrates with tin using the standard main gas temperatures of from 600 to 700° F. to coat the substrate. In the data reported below the nozzle 54 is 300 millimeters long, has a throat 58 with a diameter of 2.8 millimeters, and an exit end 60 of 12.5 millimeters by 5 millimeters. The main gas pressure is 300 psi, the main gas temperatures are as noted below, the standoff distance was 20 millimeters, and the injector tube 50 was at an angle of 45 degrees. The particles had a nominal average size of from 63 to 90 microns. The substrates were either C26000 ½ hard cartridge brass or C42500 extra spring tin brass. The C26000 has a Rockwell B hardness of 68, a yield strength of 51 ksi, and a tensile strength of 62 ksi. The C42500 is a copper alloy having a Rockwell B hardness of 92, a yield strength of 90 ksi, and a tensile strength of 92 ksi.

Figure 3:
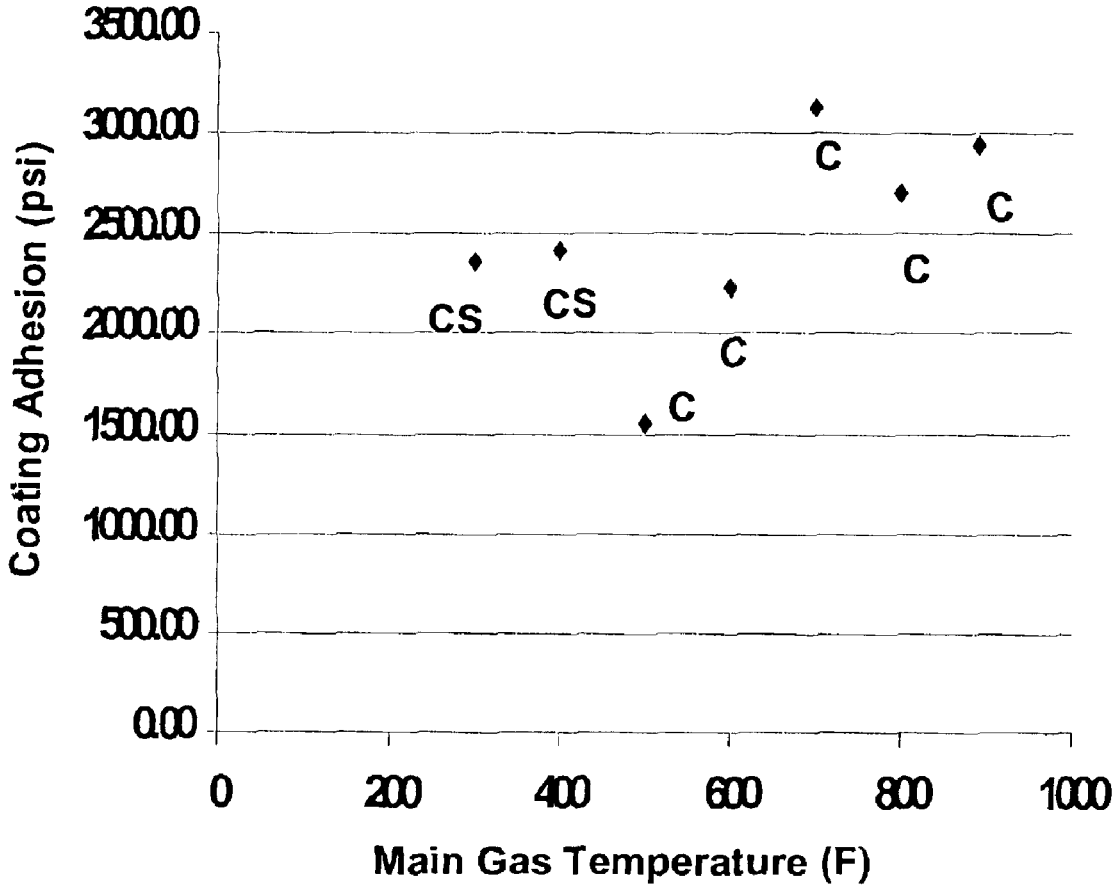
FIG. 3 is a graph of the effect of main gas temperature on cohesive and adhesive forces of a tin coating according to the present invention on a brass substrate.

Several continuous tin coatings were produced on C26000 brass substrate for adhesion testing and failure mode analysis. The substrates were coated at a traverse rate of 400 feet per minute and a particle feed rate of 73 grams per minute. Adhesion measurements were made using a Romulus adhesion tester from Quad Group. Pull studs are attached onto the tin surface with epoxy, mounted in the machine and tested until failure. FIG. 3 is a graph showing the force required to break the studs free as a function of main gas temperature used during the coating process. The failure mode was either in the coating, C in the figure, or at the coating/substrate interface, CS in the figure. For main gas temperatures below 400° F. the failure mode was observed to occur at the coating/substrate interface, these are adhesive forces. For main gas temperatures above 400° F. the failure mode was observed in the coating itself, cohesive forces. FIG. 3 shows that the force required to remove the pull studs increases with increasing main gas temperature.

Figure 4:
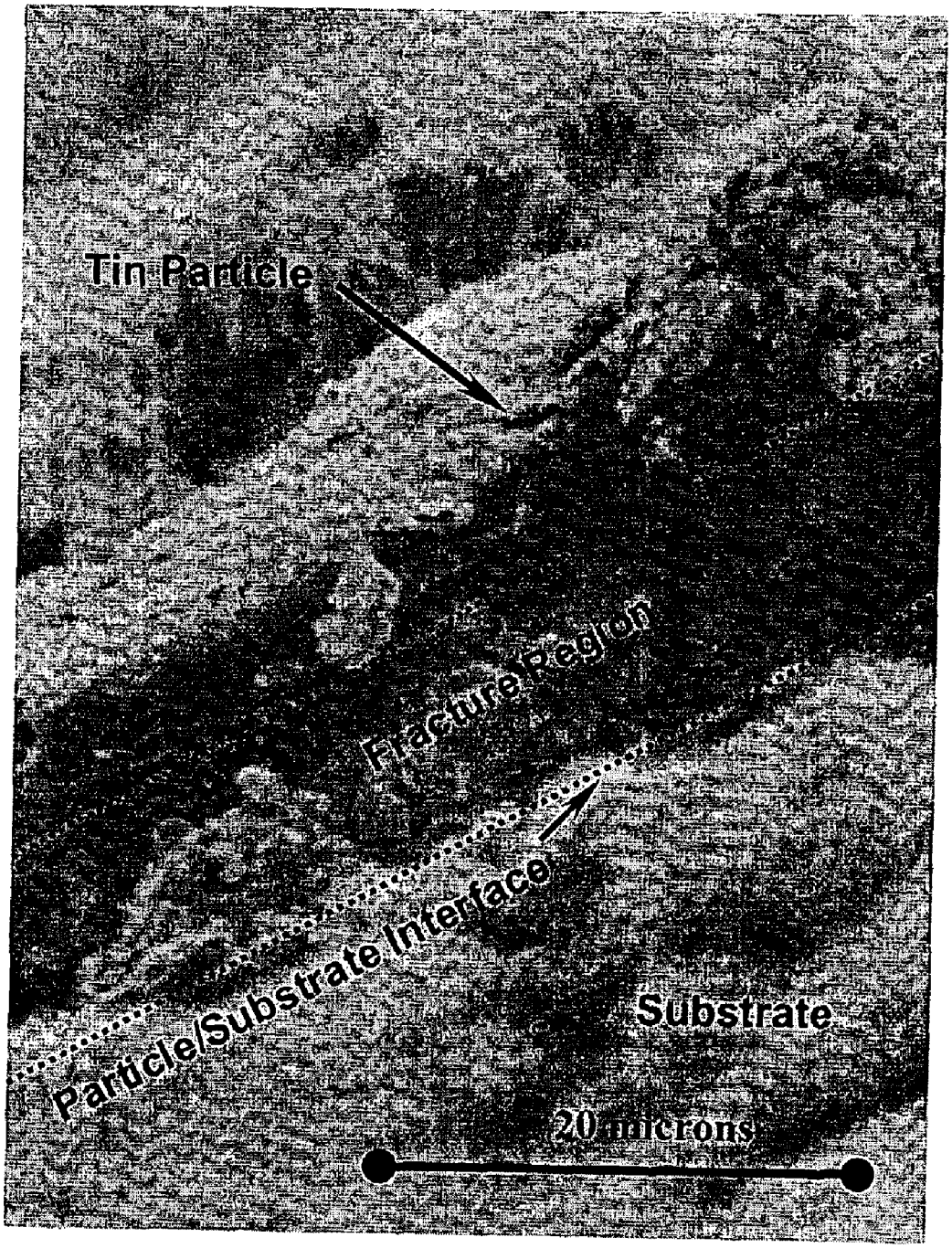
FIG. 4 is a scanning electron photomicrograph of a tin particle bonded to a brass alloy substrate not according to the present invention showing fracture regions.

It was surprisingly found that when these same spray parameters were used to attempt to coat the C42500 substrate, the coating failed. Specifically, the coating adhered to the substrate when the substrate was flat, however, when the substrate was stamped into the desired electrical terminal shape the coating failed. The typical electrical terminal is stamped out in a die that introduces several 90 degree bends into the substrate. FIG. 4 is a black and white scanning electron micrograph photo (SEM) of a tin particle bonded to the C42500 surface. The operating spray parameters were a traverse rate of 400 feet/min, a main gas temperature of 700° F., and a particle feed rate of 22 g/min. The figure shows a region from the substrate surface to approximately half way through the particle, see the dotted lines in the figure, where a zone of fractured, broken looking material is present, labeled the fracture region in the figure. The top surface of the particle appears to be intact and undamaged.

Figure 5A:
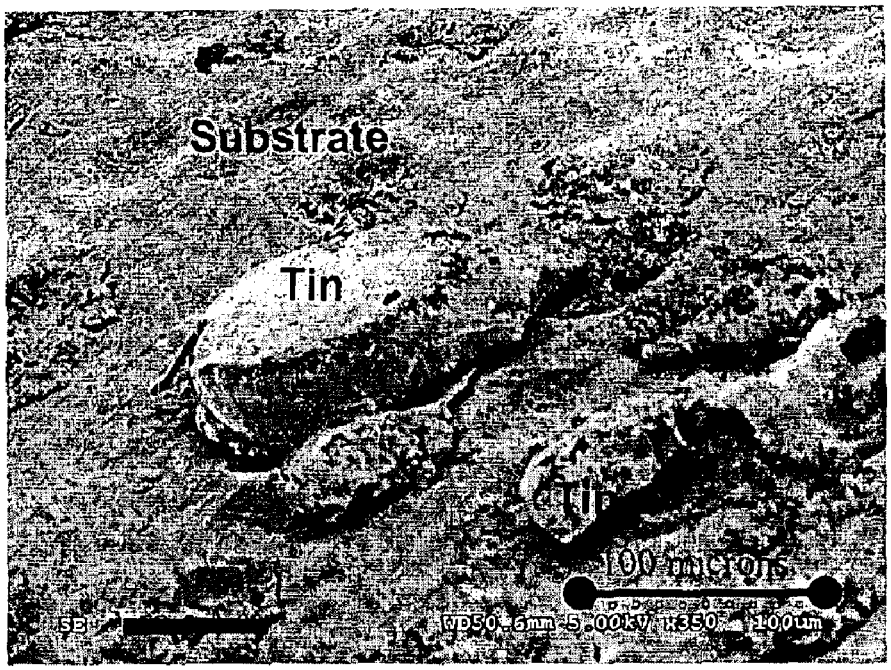
FIG. 5*a* is a scanning electron photomicrograph of a tin particle bonded to a brass alloy substrate not according to the present invention that has not been bent.
Figure 5B:
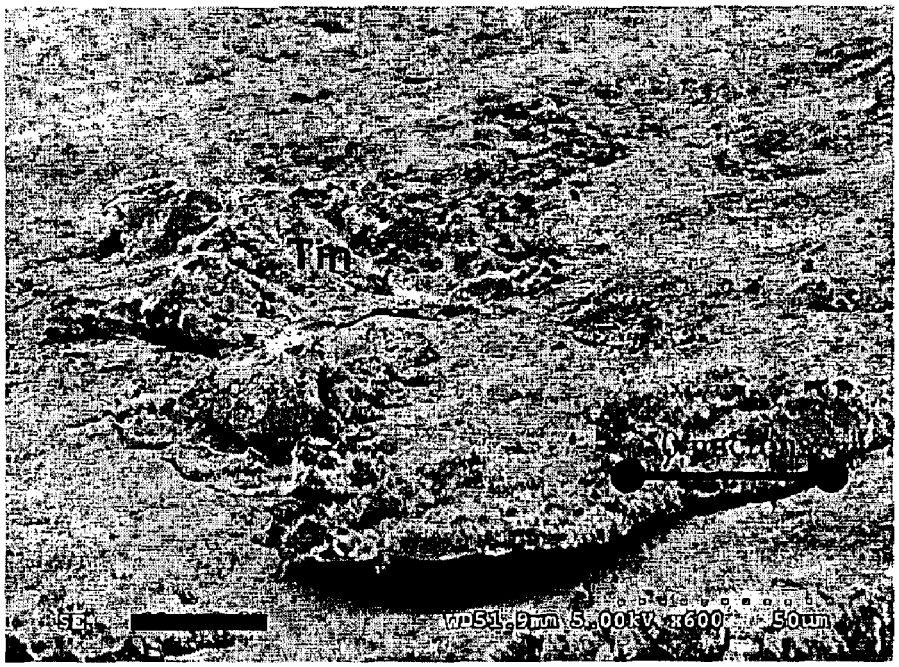
FIG. 5*b* is a scanning electron photomicrograph of a region adjacent to that show in FIG. 5*a* which has been bent at 90 degrees.

To test the adhesion of the tin particles to the C42500 substrate surface the substrate was bent 90 degrees and examined with the SEM. FIG. 5*a* is a photo of the tin particles adhered to the substrate, where no bending of the substrate has occurred. The particles appear well-rounded and adhered to the surface. FIG. 5*b* is an SEM of a region where the substrate was bent 90 degrees. In FIG. 5*b* the tin particles appear to have partially delaminated from the surface. A portion of the particle remains attached to the C42500 substrate surface. The increased material properties of the C42500, such as higher hardness, increased yield strength, and increased tensile strength appear to have caused the tin particles to internally fracture on impact. A part of the lower portion of the particles appears to be well bonded and remains attached even under severe distortion of the substrate.

It has been surprising found in the present invention that increasing the main gas temperature to a temperature of from 1000 to 1300° F. results in a superior bonding to C42500 and prevents delamination even upon severe bending. Additionally, the traverse speed was lowered to 30 to 50 feet/min and the feed rate was lowered to 20 to 30 grams/min. In part the harder surface of the C42500 is requiring more initial particle impacts to prepare the substrate surface for the subsequent arriving particles. If this were the only requirement, however, then one would assume that increasing the feed rate would compensate for the surface preparation. This was not observed to be true. Increasing the feed rate did not increase the number of adhered tin particles on the substrate surface. Instead the higher feed rates produced excess tin powder, which stuck to the oil layer on the substrate or went into the dust collector. The higher feed rates may also contribute to mass loading of the high velocity gas stream resulting in lower actual particle velocities.

Figure 6A:
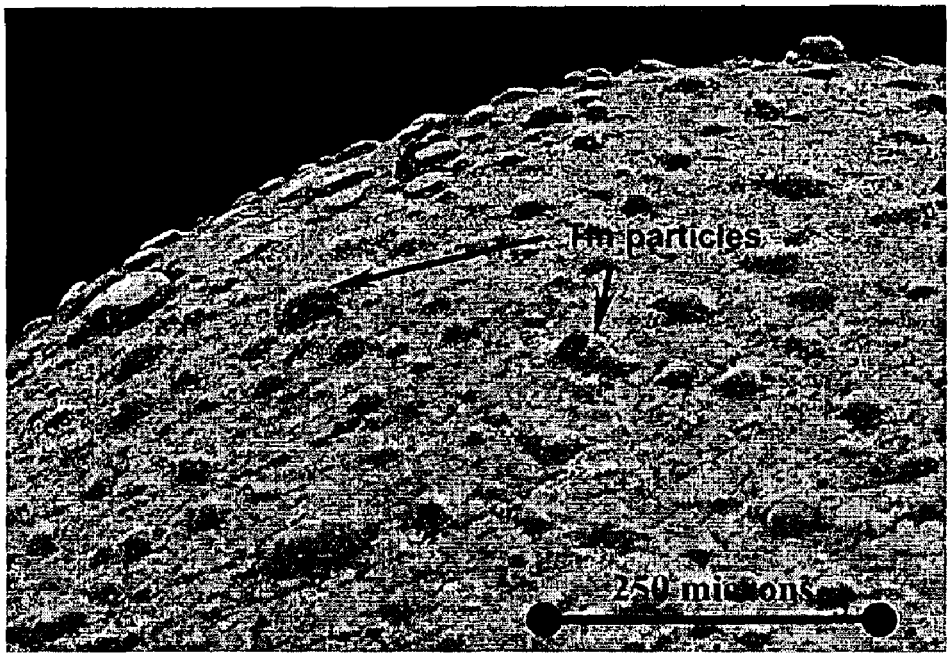
FIG. 6*a* is a scanning electron photomicrograph of tin particles bonded to a brass alloy substrate according to the present invention.
Figure 6B:
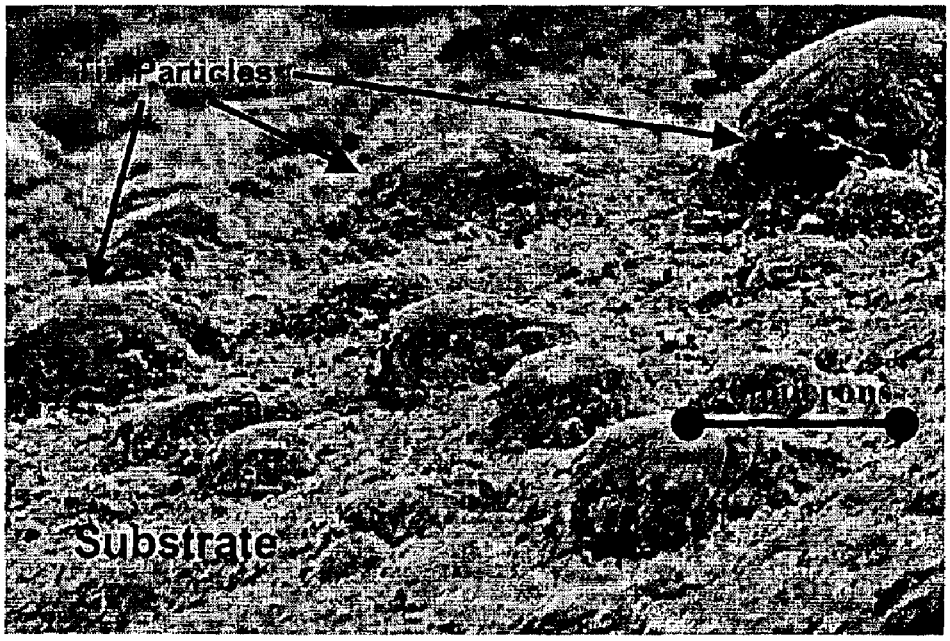
FIG. 6*b* is a scanning electron photomicrograph of tin particles bonded to a brass alloy substrate according to the present invention of FIG. 6*a* at a higher magnification.

FIGS. 6*a–b* are SEM taken of tin particles sprayed at a traverse feed rate of 40 feet/min, a main gas temperature of 1040° F., and a feed rate of 22 grams/min. FIG. 6*a* shows tin particles on the C42500 surface standing proud with the typical hemispherical appearance. One also observes in FIG. 6*b*, which is at a higher magnification, that unlike previous coatings the tin particles have both a shiny and smooth upper surface appearance. Surprisingly, when these surfaces were subjected to severe bending of 90 degrees there was no delamination of the tin particles from the substrate. Adhesion testing using a dimple punch to compound stretch the substrate in multiple directions revealed very strong bonding of the coating to the substrate. The bonding is even stronger than that observed using the previous parameters of a main gas temperature of 600 to 700° F. The particles themselves plastically deformed without debonding from the substrate surface. This is unexpected because the particles were traveling at higher particle velocities as a result of the higher main gas temperature and should have a higher degree of fracturing resulting in an increase in the number of tin fragments on the substrate after adhesion testing.

Figure 7A:
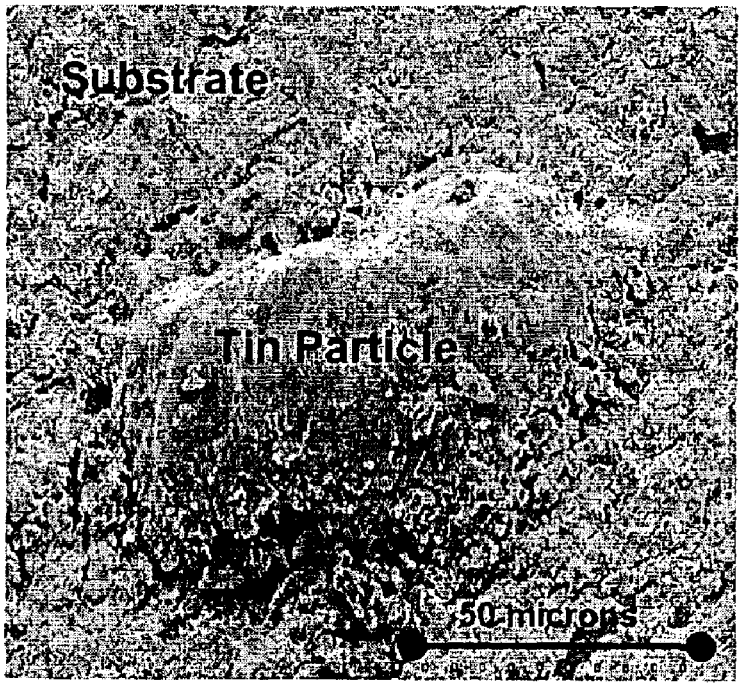
FIGS. 7*a* and 7*b* are scanning electron photomicrographs of tin particles bonded to a brass alloy substrate according to the present invention.
Figure 7B:
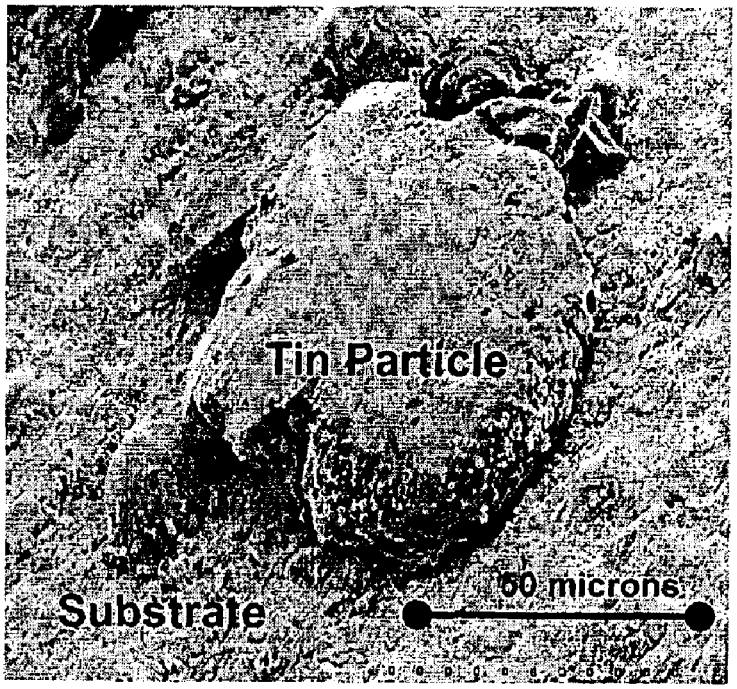
Figure 7C:
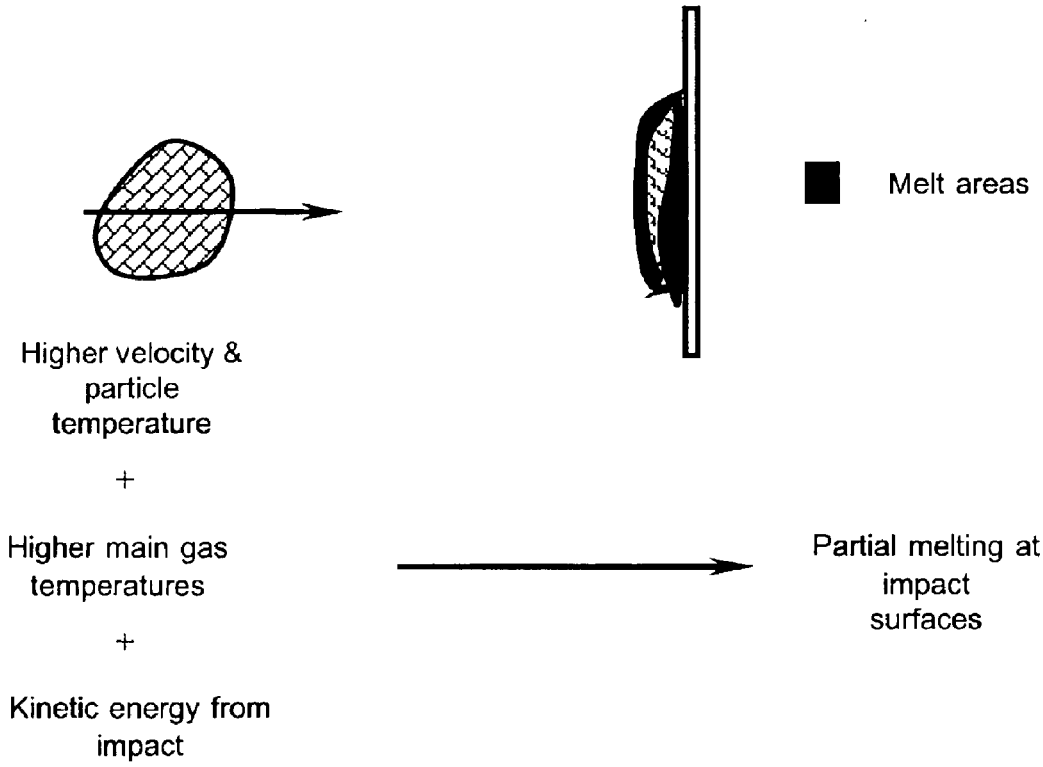
FIG. 7*c* is a schematic diagram of what may be occurring when particles are sprayed according to the present invention.

In FIGS. 7*a–b* individual tin particles are shown that clearly show retention of the rounded shape and the smooth shiny surfaces. In FIG. 7*c* a schematic showing one possible explanation for these new coatings is presented. While not wishing to bound by any single theory it is believed that the higher main gas temperature raises the particle temperature higher and increases the particle velocity to a level such that when combined with the kinetic energy released by the plastic deformation, strain and heat on impact it causes a partial melting of parts of the outer layer of the particle. It is believed that a partial melting is occurring at the upper surface region as well as at the interface between the particle and the substrate. It is obvious that the particles are not melting as in thermal spray methods. The evidence for this conclusion is two fold. First, the tin particles are still standing proud above the substrate surface and appear similar in shape to the earlier coatings, had the tin particles been molten this structure would have been destroyed before impact and thin splats similar to those observed with thermal spray would have formed after impact. Second, after severe substrate deformation no evidence is found for tin fragments on the substrate surface suggesting that the fragmented zone observed previously in FIG. 4 is not present in these new coatings. A resolidified zone of metal restoring the structural integrity of the tin particles would have replaced this fragmented region seen in FIG. 4 if a partial melting has occurred.

Figure 8A:
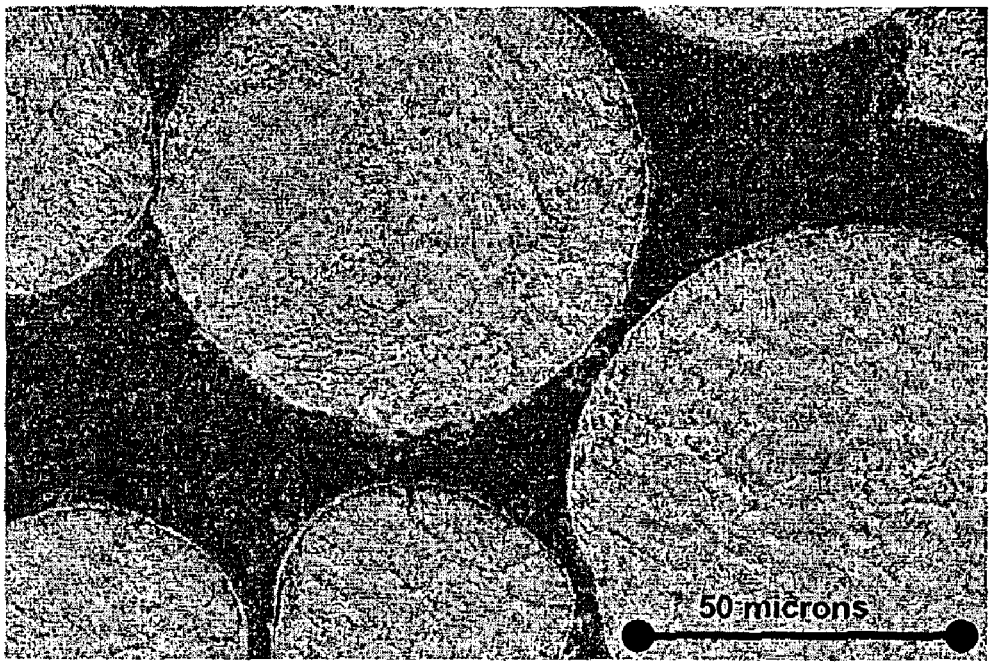
FIGS. 8*a* and 8*b* are scanning electron photomicrographs of cross-sections of tin particles prior to their being sprayed.
Figure 8B:
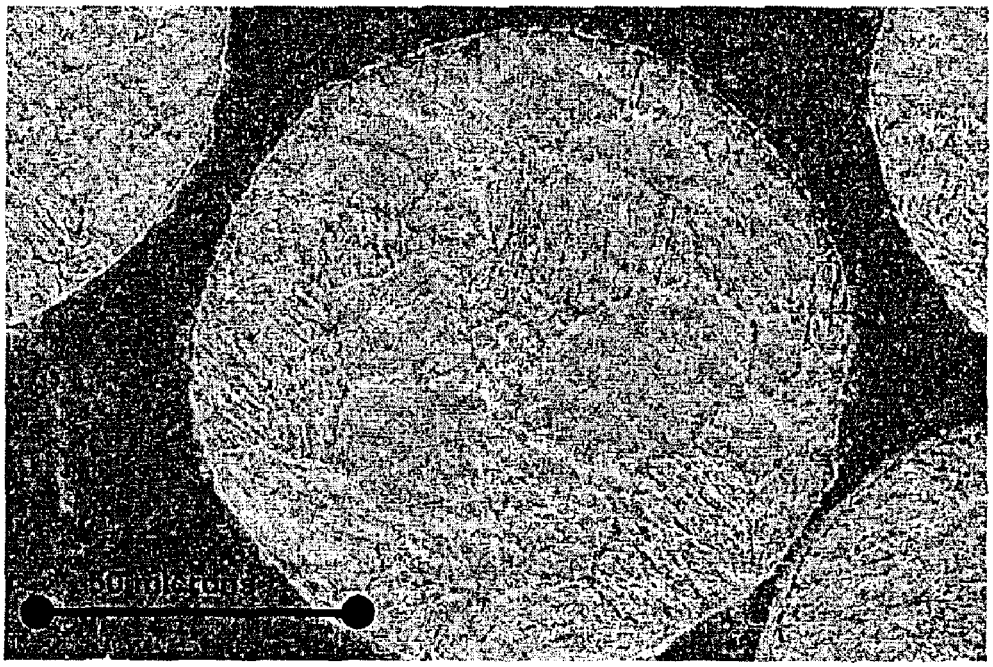

FIGS. 8*a–b* are SEM of etched cross-sections of tin particles from the initial starting powders. One can clearly distinguish the internal grain boundaries and structures of the particles before spraying. Comparing these photos with the SEMs in FIGS. 9*a–b* and 10 of the particles after impact with the substrate surface we observe several different structures not present in the initial powders.

Figure 9A:
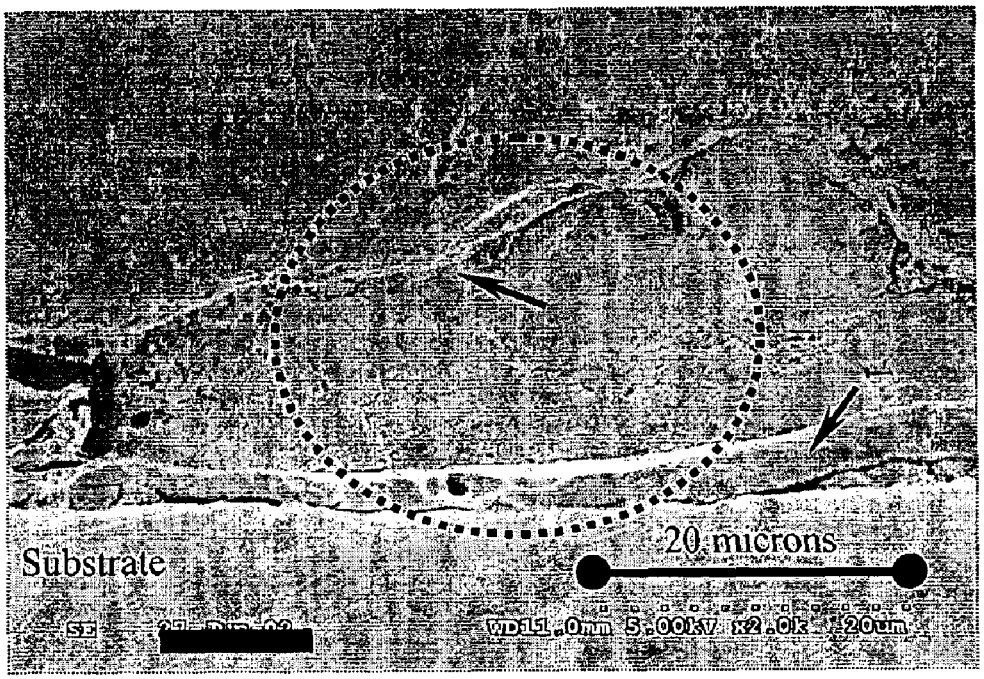
FIGS. 9*a* and 9*b* are scanning electron photomicrographs of cross-sections of a tin particle sprayed according to the present invention.
Figure 9B:
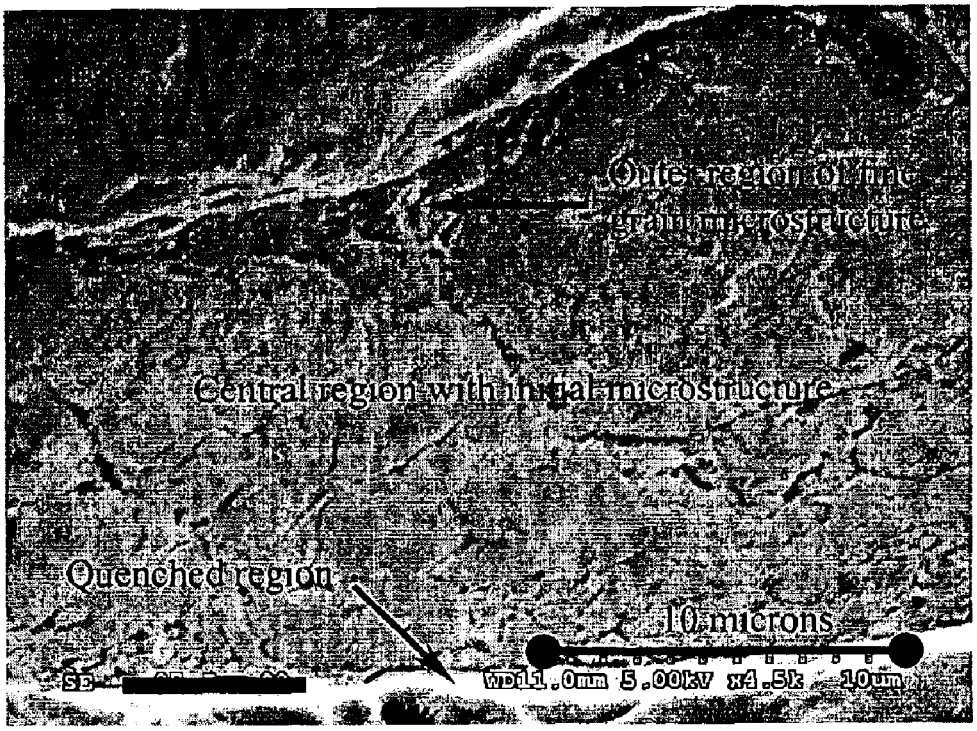

FIG. 9*a* is an SEM of a tin particle sprayed using the new high temperature method described above onto C42500. In FIG. 9*a* a thin solid looking layer at the arrow with no observable grain structure is located between the substrate and the particle. The central core of the particle appears to be composed of regions with microstructure similar to those shown in FIGS. 8*a–b*. FIG. 9*b* is a magnified image of the region noted in FIG. 9*a*. Again a thin quenched layer is present between the substrate and the particle, a thin layer having a different grain structure from the interior of the particle (see arrow in FIG. 9*b*) on the outer particle surface, a layer of plastically deformed internal grain boundaries, and an internal core region with a microstructure similar to the original particles.

Figure 10:
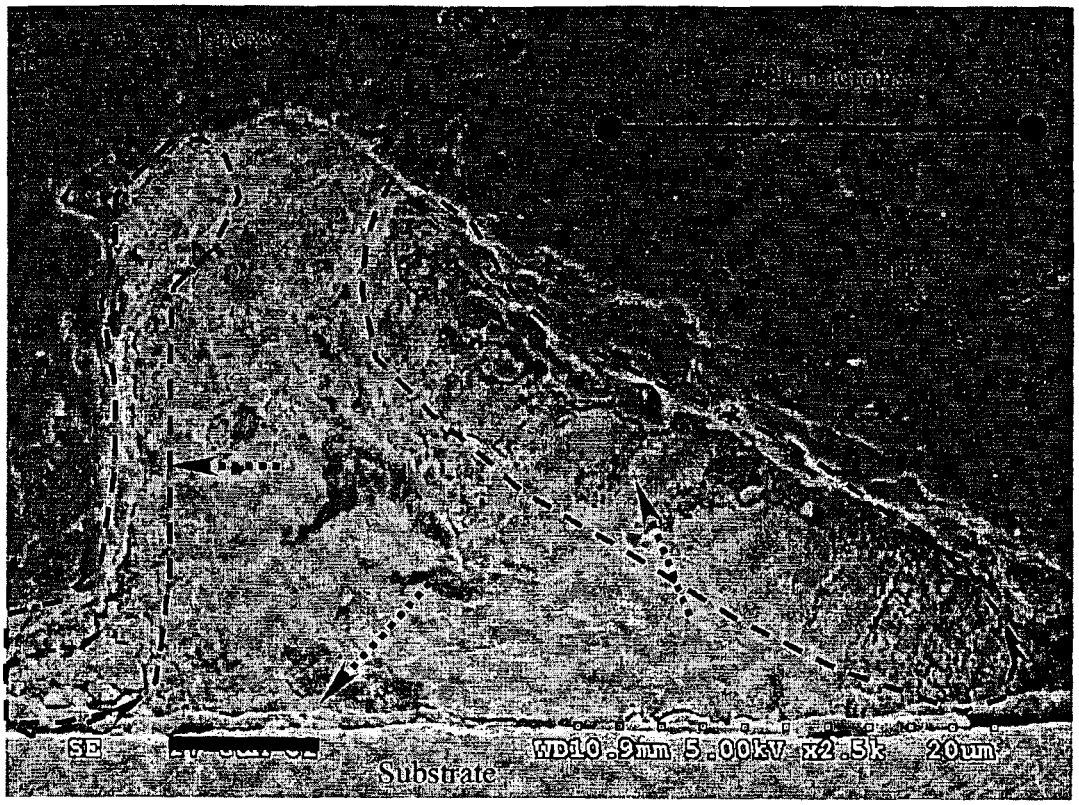
FIG. 10 is a scanning electron photomicrograph of a cross-section of a tin particle sprayed according to the present invention.

FIG. 10 is an SEM of another high temperature sprayed tin particle. Again note the thin rapidly quenched layer between the substrate and the particle and the outer edge of the particle (see arrows). Also note the thicker layer with the different microstructure on the upper surface (see dashed lined area). The SEMs in FIGS. 9*a–b* and 10 suggest that there may be selective area melting of the particles at high main gas temperatures. This selective melting presumably is responsible for the high adhesion between the substrate and the particles.

To further enhance the present invention it is possible to pre-heat the particles in the powder feeder 30. Preferably the particles are heated to within 100° F. of their melting point. Because the particles are being injected after the throat 58 these higher temperatures are possible without causing clogging of the nozzle 54.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A method of kinetic spray coating a substrate comprising the steps of:

a) providing particles of a tin to be sprayed;

b) providing a supersonic nozzle having a throat located between a converging region and a diverging region;

c) directing a flow of a gas through the nozzle, the gas having a temperature of from 1000 to 1300 degrees Fahrenheit; and d) injecting the particles directly into the diverging region of the nozzle at a point after the throat, entraining the particles in the flow of the gas and accelerating the particles to a velocity sufficient to result in partial melting of the particles upon impact on a substrate positioned opposite the nozzle and adherence of the particles to the substrate.

2. The method of claim 1, wherein step a) comprises providing particles having an average nominal diameter of from 60 to 90 microns.

3. The method of claim 1, wherein step b) comprises providing a nozzle having a throat with a diameter of from 1.5 to 3.0 millimeters.

4. The method of claim 1, wherein step b) comprises providing a nozzle having a throat with a diameter of from 2 to 3 millimeters.

5. The method of claim 1, wherein step b) comprises providing a nozzle having a largest diameter in the converging region of from 10 to 6 millimeters.

6. The method of claim 1, wherein step b) comprises providing a nozzle having a diverging region with a length of from 100 to 400 millimeters.

7. The method of claim 1, wherein step b) comprises providing a nozzle having a exit end with a long dimension of from 8 to 14 millimeters and a short dimension of from 2 to 6 millimeters.

8. The method of claim 1, wherein step c) comprises directing a flow of a gas through the nozzle, the gas having a temperature of from 1100 to 1300 degrees Fahrenheit.

9. The method of claim 1, wherein step d) comprises injecting the particles at a feed rate of from 20 to 80 grams per minute.

10. The method of claim 1, wherein step d) comprises injecting the particles at an angle of from 1 to 90 degrees.

11. The method of claim 1, wherein step d) comprises injecting the particles through an injector tube having an inner diameter of from 0.4 to 3.0 millimeters.

12. The method of claim 1, wherein step d) comprises injecting the particles into the diverging region at a distance of from 0.5 to 5.0 inches from the throat.

13. The method of claim 1, wherein step d) comprises injecting the particles into the diverging region at a distance of from 0.5 to 2.0 inches from the throat.

14. The method of claim 1, wherein step d) comprises injecting the particles into the diverging region at a distance of from 0.5 to 1.0 inches from the throat.

15. The method of claim 1, wherein step d) comprises injecting the particles at a pressure of from 5 to 60 pounds per square inch.

16. The method of claim 1, wherein step d) comprises placing the substrate at a distance of from 10 to 40 millimeters from the nozzle.

17. The method of claim 1, wherein step d) comprises placing the substrate at a distance of from 15 to 30 millimeters from the nozzle.

18. The method of claim 1, wherein step d) comprises placing the substrate at a distance of from 15 to 20 millimeters from the nozzle.

19. The method of claim 1, wherein step d) further comprises passing the substrate past the nozzle at a rate of from 20 to 400 feet per minute.

20. The method of claim 1, wherein step d) further comprises passing the substrate past the nozzle at a rate of from 30 to 50 feet per minute.

* * * * *